US009683441B2

(12) United States Patent
Signorelli et al.

(10) Patent No.: US 9,683,441 B2
(45) Date of Patent: Jun. 20, 2017

(54) POWER SUPPLY FOR WIRED PIPE WITH RECHARGEABLE ENERGY STORAGE

(71) Applicant: FASTCAP SYSTEMS CORPORATION, Boston, MA (US)

(72) Inventors: Riccardo Signorelli, Boston, MA (US); John Jacob Cooley, Boston, MA (US)

( * ) Notice: Subject to any disclaimer, the term of this patent is extended or adjusted under 35 U.S.C. 154(b) by 48 days.

(21) Appl. No.: 14/572,352

(22) Filed: Dec. 16, 2014

(65) Prior Publication Data

US 2015/0096744 A1 Apr. 9, 2015

Related U.S. Application Data

(63) Continuation-in-part of application No. 13/669,396, filed on Nov. 5, 2012.

(60) Provisional application No. 61/916,526, filed on Dec. 16, 2013, provisional application No. 61/555,100, filed on Nov. 3, 2011, provisional application No. 61/624,080, filed on Apr. 13, 2012.

(51) Int. Cl.
*H02J 7/00* (2006.01)
*E21B 47/12* (2012.01)
*E21B 41/00* (2006.01)

(52) U.S. Cl.
CPC ..... *E21B 47/122* (2013.01); *E21B 41/0085* (2013.01)

(58) Field of Classification Search
USPC ..... 320/166
See application file for complete search history.

(56) References Cited

U.S. PATENT DOCUMENTS 5,831,934 A * 11/1998 Gill ..... G01V 1/48 367/25
2012/0028086 A1* 2/2012 Shi ..... H01G 11/52 429/50

* cited by examiner

*Primary Examiner* — Robert Grant
(74) *Attorney, Agent, or Firm* — Wolf, Greenfield & Sacks LP

(57) ABSTRACT

A power supply for a wired pipe system is provided. The power supply includes energy storage capabilities, and provides for operation in high temperature environments.

24 Claims, 3 Drawing Sheets

POWER SUPPLY FOR WIRED PIPE WITH RECHARGEABLE ENERGY STORAGE

CROSS REFERENCE TO RELATED APPLICATIONS

The present application claims priority to U.S. Provisional Patent Application No. 61/916,526, filed Dec. 16, 2013; the present application is a continuation-in-part of co-pending U.S. patent application Ser. No. 13/669,396 filed Nov. 5, 2012, which in turn claims priority to U.S. Provisional Application No. 61/555,100 filed Nov. 3, 2011 and U.S. Provisional Application No. 61/624,080 filed Apr. 13, 2012. The entire contents of each of the foregoing applications are incorporated herein by reference.

BACKGROUND OF THE INVENTION

In the exploration for oil and gas, it is necessary to drill a wellbore into the Earth. While drilling of the wellbore permits individuals and companies to evaluate sub-surface materials and to extract desired hydrocarbons, many problems are encountered.

For example, it is well known that the "easy oil" is generally gone. Exploration now requires searching to greater depths than ever before. This necessitates drilling deeper and deeper, and thus into harsh environments, such as those having temperatures ranging from 200 degrees Celsius up to or in excess of 300 degrees Celsius. Generally, present day instrumentation is not built to operate in such an environment, and will fail well before reaching ambient temperatures within this range.

The growing complexity of downhole instrumentation further complicates this problem. That is, as technology continues to improve, exploration is making use of more instrumentation than ever before. With this usage comes an increased demand for power downhole.

Unfortunately, many of the known solutions have substantial drawbacks. For example, various types of batteries suffer catastrophic failure at elevated temperature, and can thus destroy instrumentation. Additionally, such batteries often are not rechargeable, as well as quite expensive.

What are needed are methods and apparatus to provide power downhole in environments that have temperatures ranging from ambient environmental temperatures up to about 200 degrees Celsius or higher, including up to about 300 degrees Celsius.

SUMMARY

In one aspect, a wired pipe segment is disclosed for use in a downhole environment, the wired pipe segment including: an uphole connection for outputting or receiving electromagnetic signals to or from an uphole location; a downhole connection for outputting or receiving electromagnetic signals to or from a downhole location; and a booster for boosting the power of an electromagnetic signal received from one of the uphole connection and the downhole connection and outputting a boosted signal to the other one of the uphole connection and the downhole connection.

In some embodiments, the booster comprises at least one high temperature rechargeable energy storage (HTRES). In some embodiments, the HTRES is configured to operate at temperatures throughout an operational temperature range. In some embodiments, the operational temperature range may include 0 C to 150 C, 0 C to 175 C, 0 C to 200 C, 0 C to 210 C, 0 C to 225 C, 0 C to 250 C, −40 C to 150 C, −40 C to 175 C, −40 C to 200 C, −40 C to 210 C, −40 C to 225 C, −40 C to 250 C, or wider ranges, e.g., −40 C to 300 C or any sub-range thereof.

In some embodiments, the HTRES is configured to output power with a peak power of at least 1 W, 10 W, 50 W, 100 W, 500 W, 1 kW, 2 kW, 3 kW, 4 kW, 5 kW, 10 kW, 20 kW, 30 kW, 40 kW, 50 kW, 100 kW, 200 kW, 300 kW, 400 kW, 500 kW, 1,000 kW or more, e.g., in the range of 1 W to 1,000 kW or any sub-range thereof.

In some embodiments, the HTRES is configured to operate in the presence of vibrations of up to maximum vibration rating for an operational period. In some embodiments the operational period is at least 100 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof. In some embodiments the operational period is at least 500 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof. In some embodiments the operational period is at least 1,000 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof. In some embodiments the operational period is at least 5,000 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof.

In some embodiments, the HTRES is configured to operate in the presence of shocks up to a maximum shock rating. In some embodiments, the maximum shock rating may be at least 10 G, 20 G, 30 G, 50 G, 100 G, 200, G, 300 G, 400 G, 500 G, or more, e.g., in the range of 10 G to 1,000 G or any sub-range thereof.

In some embodiments the HTRES comprises an ultracapacitor. In some embodiments, the ultracapacitor is capable of operating with the same or better electrical, temperature, vibration, and shock performance levels set forth above with respect to the HTRES.

In some embodiments, the ultracapacitor may, for example, operate at temperatures as high as 250 degrees Celsius or more for 10,000 charge/discharge cycles and/or over 100 hours or more at a voltage of 0.5 V or more while exhibiting and increase in ESR or less than 100%, e.g. less than about 85%, and a decrease in capacitance of less than about 10%. In some embodiments, such ultracapacitors may have a volumetric capacitance of about 5 Farad per liter (F/L), 6 F/L, 7 F/L, 8 F/L, 8 F/L, 10 F/L or more, e.g., in the range of about 1 to about 10 F/L or any sub-range thereof.

In some embodiments, ultracapacitors of the types described herein may exhibit any of: a high volumetric energy density (e.g., exceeding 0.25 Wh/L, 0.5 Wh/L, 1 Wh/L, 2 Wh/L, 3 Wh/L, 4 Wh/L, 5 Wh/L, 6 Wh/L, 7 Wh/L, 8 Wh/L, 9 Wh/L, 10 Wh/L, 11 Wh/L, 12 Wh/L, 15 Wh/L, 18 Wh/L, 20 Wh/L, or more), a high gravimetric energy density (e.g., exceeding 5 Wh/kg, 6 Wh/kg, 7 Wh/kg, 8 Wh/kg, 9 Wh/kg, 10 Wh/kg, 11 Wh/kg, 12 Wh/kg, 15 Wh/kg, 18 Wh/kg, or more), a high volumetric power density (e.g., exceeding 30 kW/L, 40 kW/L, 50 kW/L, 60 kW/L, 70 kW/L, 80 kW/L, 90 kW/L, 100 kW/L, 110 kW/L, 120 kW/L, or more), a high gravimetric power density (e.g., exceeding 30 kW/kg, 40 kW/kg, 50 kW/kg, 60 kW/kg, 70 kW/kg, 80 kW/kg, 90 kW/kg, 100 kW/kg, 110 kW/kg, 120 kw/KG or more), and combinations thereof. In some embodiments, ultracapacitors of the types described herein demonstrate high performance as indicated by the product of energy density and power density, e.g., exceeding 300 Wh-kW/$L^2$, 500 Wh-kW/$L^2$, 700 Wh-kW/$L^2$, or more.

In some embodiments, ultracapacitors disclosed herein are capable of maintaining their performance over a long period of time, e.g., hundreds of thousands, or even millions of charge/discharge cycles, even in the presence of vibration and shock levels as set forth above.

In some embodiment, the ultracapacitor is configured to: store energy input from an energy source at a relatively lower power and relatively more constant rate; and output energy at a relatively higher power at a relatively more pulsed or intermittent rate. In some embodiments, the energy source comprises at least one of: a battery, a downhole generator, a wire line, and combinations thereof.

In some embodiments, the HTRES is configured to provide pulsed power to one or more downhole instruments having intermittent peak power demand.

In some embodiments, the energy source comprises a battery included in the wired pipe segment. In some embodiments, the battery comprises a lithium battery. In other embodiments, the wired pipe segment is substantially free of any lithium based energy storage elements (e.g., employing only lithium free batteries). In some embodiments, the battery may have a lower peak power output, operating voltage, or other operating characteristic than would have been required for a given application in the absence of the booster.

In some embodiments, the wired pipe segment includes control electronics configured to control the booster.

In some embodiments the electromagnetic signal boosted by the booster comprises encoded information. In some such environments, the control electronics and booster are configured to operate as a signal repeater. In some embodiments, the signal repeater is configured to detect the encoded information; and generate a power boosted electromagnetic signal encoded with the detected information.

In some embodiments, the control electronics are configured to: receive an external control signal via one of the downhole connection and the uphole connection; and control the booster in response to the external control signal.

Some embodiments of the wired pipe segment include a wire or cable providing an electrically conducting connection between the uphole connection and the downhole connection. In some such embodiments, the booster is configured to boost an electromagnetic signal transmitted through the wire or cable. In some embodiments, the wire or cable is formed of a material having a higher tensile and/or shear strength than copper or aluminum and a lower electrical conductivity than copper or aluminum. For example, in some embodiments, the material includes steel.

In another aspect, a system is disclosed including: a wired downhole pipe including a plurality of wired pipe segments or any of the types described above or herein including a booster. In some embodiments, the wired downhole pipe comprises a drill pipe or a well pipe. In some embodiments, the wired downhole pipe provides power from an uphole or topside power source to one or more downhole instruments. In some embodiments, the wired pipe segment including the booster provides at least one of: power demand smoothing for the uphole or topside power source; and pulsed peak power output higher than a maximum peak power output of the uphole or topside power source.

In some embodiments, the wired downhole pipe provides an electromagnetic communication link between a topside transmitter and at least one downhole instrument. In some such embodiments, the wired pipe segment including the booster is configured to boost a signal transmitted to or from the downhole instrument via the electromagnetic communication link. In some embodiments, the electromagnetic communication link is configured to have a bitrate of at least 1 kilobit per second, 10 kilobits per second, 100, kilobits per second, 1 megabit per second, 5 megabits per second, 10 megabits per second, 20 megabits per second, 30 megabits per second, 40 megabits per second, 50 megabits per second or more, e.g., in the range of 1 kilobit per second to 100 megabits per second or any sub-range thereof. In some embodiments, the bit rate is higher than the maximum bit rate available in the absence of any pipe segments having boosters by a factor of at least 2, 3, 4, 5, 6, 7, 8, 9, 10, or more.

In some embodiments, the system can establish a communication link at a minimum transmission power that is less than the minimum transmission power in the absence of any pipe segments having boosters by a factor of at least 2, 3, 4, 5, 6, 7, 8, 9, 10, or more.

In some embodiments, the wired downhole pipe extends downhole to depths of at least 1,000 feet, 2,000 feet, 5,000 feet, 10,000 feet, 20, 000 feet, 50,000 feet, or more, e.g., in the range of 1,000 to 50, 000 feet.

In some embodiments, the wired downhole pipe comprises a lateral section extending laterally at least 1,000 feet, 2,000 feet, 5,000 feet, 10,000 feet, 20, 000 feet, 50,000 feet, or more, e.g. at a depth of at least 1,000 feet, 2,000 feet, 5,000 feet, 10,000 feet, 20, 000 feet, 50,000 feet, or more. In some embodiments, the system is configured to provide a transmission link or power to one or more downhole instruments located at or near the downhole end of the pipe, despite the significant depth and/or lateral offset of the pipe.

In another aspect, a method is disclosed including: providing a wired downhole pipe including a system of the type described above or herein, and transmitting power or information between a topside or uphole location and one or more downhole instruments using the system.

In some embodiments, the method includes operating the system under downhole conditions. For example, some embodiments include operating the system at temperatures throughout an operational temperature range. In some embodiments, the operational temperature range may include 0 C to 150 C, 0 C to 175 C, 0 C to 200 C, 0 C to 210 C, 0 C to 225 C, 0 C to 250 C, −40 C to 150 C, −40 C to 175 C, −40 C to 200 C, −40 C to 210 C, −40 C to 225 C, −40 C to 250 C, or even wider ranges, e.g., −40 to 300 C or any sub-range thereof. Some embodiments include operating the system in environment shave temperatures of at least 150 C, 175 C, 200 C, 210 C, 225 C, 250 C, or more.

In some embodiments the system is operated in the presence of vibrations of up to maximum vibration rating for an operational period. In some embodiments the operational period is at least 100 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof. In some embodiments the operational period is at least 500 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof. In some embodiments the operational period is at least 1,000 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof. In some embodiments the operational period is at least 5,000 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof.

In some embodiments, the system is operated in the presence of shocks up to a maximum shock rating. In some embodiments, the shock rating may be at least 10 G, 20 G, 30 G, 50 G, 100 G, 200, G, 300 G, 400 G, 500 G, or more, e.g., in the range of 10 G to 1,000 G or any sub-range thereof.

Various embodiments may include any of the above described features, elements, steps, etc., either alone, or in any suitable combination.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Disclosed herein are various configurations of a power supply adapted for use in a downhole environment. The power supply provides users with power generation and/or distribution in a high temperature environment. In order to provide context for the power supply, some background information and definitions are provided.

Figure 1:
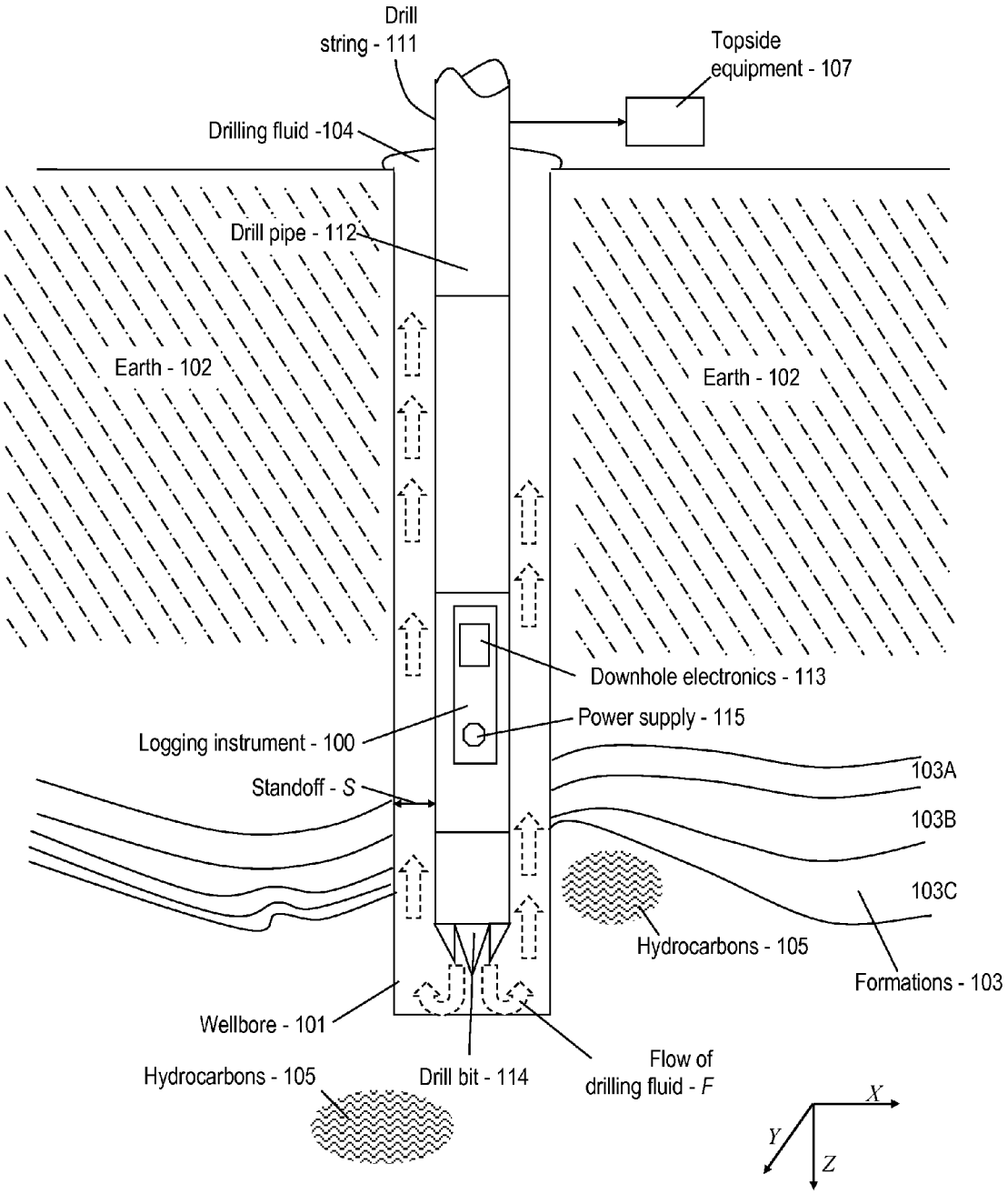
FIG. 1 illustrates an exemplary embodiment of a drill string that includes a logging instrument.

Refer now to FIG. 1 where aspects of an apparatus for drilling a wellbore 101 (also referred to as a "borehole") are shown. As a matter of convention, a depth of the wellbore 101 is described along a Z-axis, while a cross-section is provided on a plane described by an X-axis and a Y-axis.

In this example, the wellbore 101 is drilled into the Earth 102 using a drill string 111 driven by a drilling rig (not shown) which, among other things, provides rotational energy and downward force. The wellbore 101 generally traverses sub-surface materials, which may include various formations 103 (shown as formations 103A, 103B, 103C). One skilled in the art will recognize that the various geologic features as may be encountered in a subsurface environment may be referred to as "formations," and that the array of materials down the borehole (i.e., downhole) may be referred to as "sub-surface materials." That is, the formations 103 are formed of sub-surface materials. Accordingly, as used herein, it should be considered that while the term "formation" generally refers to geologic formations, and "sub-surface material," includes any materials, and may include materials such as solids, fluids, gases, liquids, and the like.

In this example, the drill string 111 includes lengths of drill pipe 112 which drive a drill bit 114. The drill bit 114 also provides a flow of a drilling fluid 104, such as drilling mud. The drilling fluid 104 is often pumped to the drill bit 114 through the drill pipe 112, where the fluid exits into the wellbore 101. This results in an upward flow, F, of drilling fluid 104 within the wellbore 101. The upward flow, F, generally cools the drill string 111 and components thereof, carries away cuttings from the drill bit 114 and prevents blowout of pressurized hydrocarbons 105.

The drilling fluid 104 (also referred to as "drilling mud") generally includes a mixture of liquids such as water, drilling fluid, mud, oil, gases, and formation fluids as may be indigenous to the surroundings. Although drilling fluid 104 may be introduced for drilling operations, use or the presence of the drilling fluid 104 is neither required for nor necessarily excluded from well logging operations. Generally, a layer of materials will exist between an outer surface of the drill string 111 and a wall of the wellbore 101. This layer is referred to as a "standoff layer," and includes a thickness, referred to as "standoff, S."

The drill string 111 generally includes equipment for performing "measuring while drilling" (MWD), also referred to as "logging while drilling" (LWD). Performing MWD or LWD generally calls for operation of a logging instrument 100 that in incorporated into the drill string 111 and designed for operation while drilling. Generally, the logging instrument 100 for performing MWD is coupled to an electronics package which is also on board the drill string 111, and therefore referred to as "downhole electronics 113." Generally, the downhole electronics 113 provides for at least one of operational control and data analysis. Often, the logging instrument 100 and the downhole electronics 113 are coupled to topside equipment 107. The topside equipment 107 may be included to further control operations, provide greater analysis capabilities as well as data logging and the like. A communications channel (not shown) may provide for communications to the topside equipment 107, and may operate via pulsed mud, wired pipe (e.g., as described herein), and other technologies as are known in the art.

Generally, data from the MWD apparatus provide users with enhanced capabilities. For example, data made available from MWD evolutions may be useful as inputs to geosteering (i.e., steering the drill string 111 during the drilling process) and the like.

Figure 2:
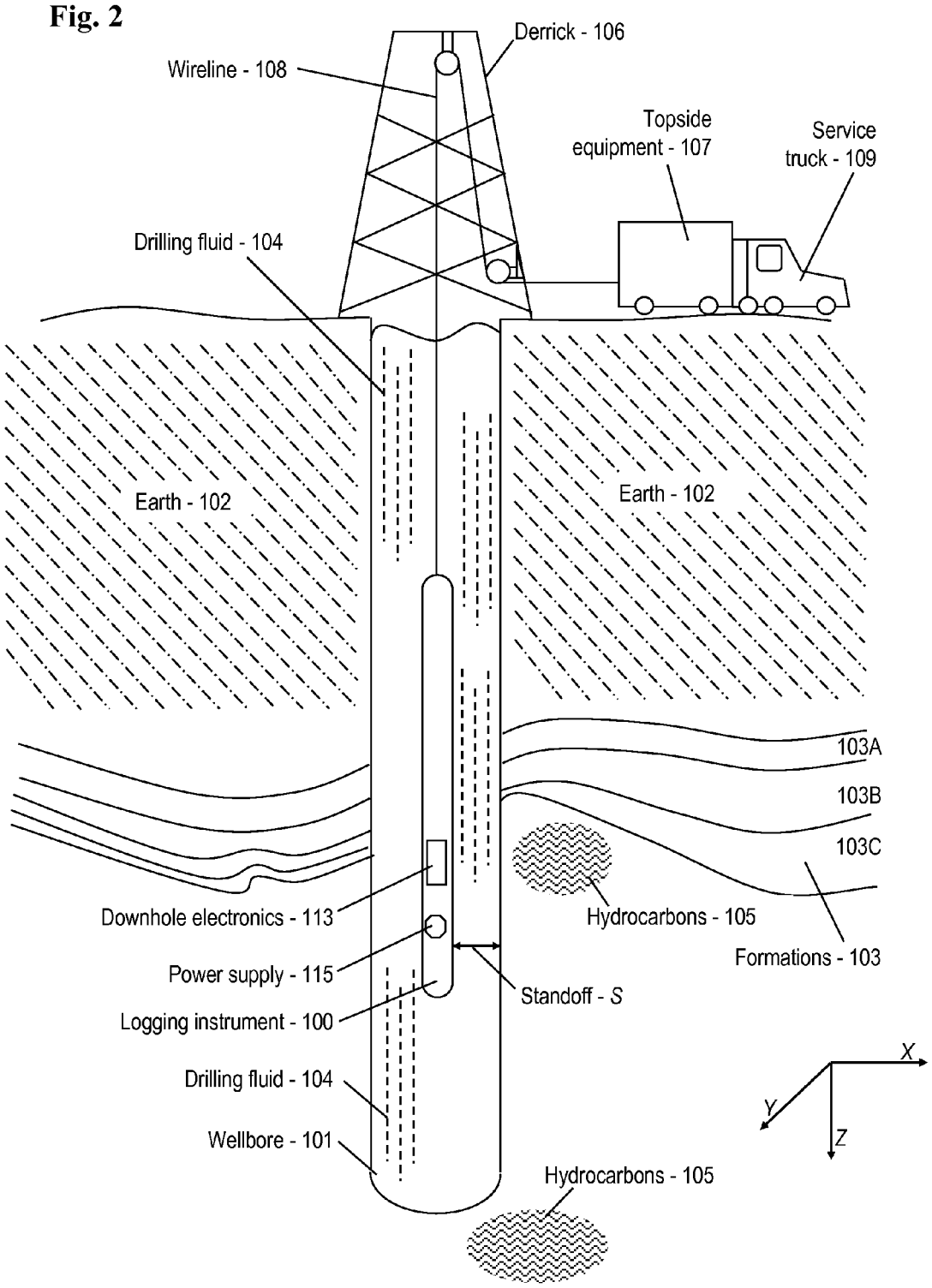
FIG. 2 illustrates an exemplary embodiment for well logging with an instrument deployed by a wireline.

Referring now to FIG. 2, an exemplary logging instrument 100 for wireline logging of the wellbore 101 is shown. As a matter of convention, a depth of the wellbore 101 is described along a Z-axis, while a cross-section is provided on a plane described by an X-axis and a Y-axis. Prior to well logging with the logging instrument 100, the wellbore 101 is drilled into the Earth 102 using a drilling apparatus, such as the one shown in FIG. 1.

In some embodiments, the wellbore 101 has been filled, at least to some extent, with drilling fluid 104. The drilling fluid 104 (also referred to as "drilling mud") generally includes a mixture of liquids such as water, drilling fluid, mud, oil, gases, and formation fluids as may be indigenous to the surroundings. Although drilling fluid 104 may be introduced for drilling operations, use or the presence of the drilling fluid 104 is neither required for nor necessarily excluded from logging operations during wireline logging. Generally, a layer of materials will exist between an outer surface of the logging instrument 100 and a wall of the wellbore 101. This layer is referred to as a "standoff layer," and includes a thickness, referred to as "standoff, S."

Generally, the logging instrument 100 is lowered into the wellbore 101 using a wireline 108 deployed by a derrick 106 or similar equipment. Generally, the wireline 108 includes suspension apparatus, such as a load bearing cable, as well as other apparatus. The other apparatus may include a power supply, a communications link (such as wired or optical) and other such equipment. Generally, the wireline 108 is conveyed from a service truck 109 or other similar apparatus (such as a service station, a base station, etc, . . . ). Often, the wireline 108 is coupled to topside equipment 107. The topside equipment 107 may provide power to the logging instrument 100, as well as provide computing and processing capabilities for at least one of control of operations and analysis of data.

Generally, the logging instrument 100 includes a power supply 115. The power supply 115 may provide power to downhole electronics 113 (i.e., power consuming devices) as appropriate. Generally, the downhole electronics 113 provide measurements, perform sampling, as well as any other sequences desired to locate, ascertain and qualify a presence of hydrocarbons 105.

As an overview, the power supply 115 generally includes electrical storage and a generator for generating electrical output. The energy storage may include any type of technology practicable. In various embodiments, the energy storage includes at least one ultracapacitor, e.g., as described in greater detail below. Generally, in each instance, the energy storage provides a High Temperature Rechargeable Energy Storage (HTRES).

Additional embodiments of HTRES include, without limitation, chemical batteries, for instance aluminum electrolytic capacitors, tantalum capacitors, ceramic and metal film capacitors, hybrid capacitors magnetic energy storage, for instance, air core or high temperature core material inductors. Other types of that may also be suitable include, for instance, mechanical energy storage devices, such as fly wheels, spring systems, spring-mass systems, mass systems, thermal capacity systems (for instance those based on high thermal capacity liquids or solids or phase change materials), hydraulic or pneumatic systems. One example is the high temperature hybrid capacitor available from Evans Capacitor Company Providence, R.I. USA part number HC2D060122 DSCC10004-16 rated for 125 degrees Celsius. Another example is the high temperature tantalum capacitor available from Evans Capacitor Company Providence, R.I. USA part number HC2D050152HT rated to 200 degrees Celsius. Yet another example is an aluminum electrolytic capacitor available from EPCOS Munich, Germany part number B41691A8107Q7, which is rated to 150 degrees Celsius. Yet another example is the inductor available from Panasonic Tokyo, Japan part number ETQ-P5M470YFM rated for 150 degrees Celsius. Additional embodiments are available from Saft, Bagnolet, France (part number Li-ion VL 32600-125) operating up to 125 degrees Celsius with 30 charge-discharge cycles, as well as a li-ion battery (experimental) operable up to about 250 degrees Celsius, and in experimental phase with Sadoway, Hu, of Solid Energy in Cambridge, Mass.

As a matter of discussion, embodiments of the power supply 115 discussed herein involve use of a high temperature ultracapacitor, however, this is not limiting of technologies that may be included in the energy storage of the power supply 115. Exemplary aspects of an ultracapacitor suited for use as the high temperature energy storage are now introduced.

Disclosed herein is a capacitor that provides users with improved performance over a wide range of temperatures. For example, the capacitor may be operable at temperatures ranging from about as low as −40 C to as high as about 250 C or more. In some embodiments, the capacitor is operable temperatures ranging from about 80 degrees Celsius to as high as about 250 degrees Celsius or more, or other ranges as set forth herein.

In general, the capacitor includes energy storage media that is adapted for providing high power density and high energy density. The capacitor includes components that are configured for ensuring operation over the temperature range, and includes any one or more of a variety of forms of electrolyte that are likewise rated for the temperature range. The combination of construction, energy storage media and electrolyte result in capabilities to provide robust operation under extreme conditions. To provide some perspective, aspects of an exemplary embodiment are now introduced.

In summary, the teachings herein provide for a reliable power supply in downhole tools that is available for use in high temperature environments.

In some instances, wired pipe replaces a conventional pipe and is used to convey electricity to and from downhole instruments and systems. The conveyed electricity generally may comprise transmitted information and/or power and may generally be bi-directional, i.e. power or information may flow from the surface to the downhole instrument and/or from the downhole instrument to the surface. A wired pipe such as that disclosed in U.S. Pat. No. 6,641,434 ("Boyle") may be employed in a drilling or production operation for the purpose of conveying said electrical signals. National Oilwell Varco with offices in Houston, Tex., has commercialized a technology for wired pipe called "Intelliserv," with similar features to those described in Boyle—notably an inductively coupled port at each end of wired pipe sections. Together Boyle and Intellisery will be referred to forthwith as the inductively coupled wired pipe "ICWP." A wired pipe system with conductive connections rather than inductively coupled ports is described in U.S. Pat. No. 7,857,644 ("Madhavan"). A key benefit to the ICWP is that it can support data transmission of between about 50,000 and 1,000,000 bits per second (bps), about 20,000 times the rate afforded by other data transmission techniques such as mud pulse or EM transmissions. The entire contents of Boyle and Madhavan are incorporated herein by reference.

Generally, a key to the design of wired pipe is that it exhibits high strength—tensile and sheer. Another key to the design of wired pipe is that it is robust to unreliable electrical conduction at the joints of the pipe. A benefit of the ICWP is that transmission does not rely on a substantial conductive interconnection at each of the joints. Transmission of electrical signals is supported by inductive coupling at each of the pipe joints—the transmission is accomplished wirelessly over a relatively short distance by means of inductive coupling. Notably, the signals comprise alternating voltages and currents (AC) to accomplish transmission across the inductively coupled joints. Either AC or direct current (DC) electricity may be employed in the case of conductive connections as in Madhavan.

A particular drawback of wired pipe and in ICWP in particular is that electrical signals are attenuated as they travel along lengths of pipe and across inductively coupled joints. Conventional ICWP requires "booster subs" or "boosters" to restore attenuated signals at pre-determined intervals, for instance, every 1,000-10,000 ft. In the ICWP, boosters typically comprise an energy source and in some embodiments the energy source comprises at least one of generators and lithium batteries as well as electronics to receive, condition, and restore an electrical signal. The electronics may comprise sensing circuitry, as well as power electronics including DC/AC converters, AC/DC converters and DC/DC converters as well as microprocessors, embedded systems, and control electronics. Notably the above mentioned systems including the wired pipe, batteries and electronics must be designed to survive and operate in relatively harsh conditions—temperatures exceeding about 85 degrees Celsius, vibrations exceeding about 2 Grms, and mechanical shocks exceeding about 10 G. A drawback of the booster embodiment described above is that the lithium batteries have a capacity (between about 10 and 50 Ah and between about 10 and 50 V for a total energy between about 100 and 2500 Wh), and they are prone to failure, sometimes catastrophic failure that can lead to loss of equipment or dangerous consequences for users. The lithium batteries are also limited in power, as they are normally only able to provide between about 1 and 100 W, the higher power batteries exhibiting increasingly unfavorable drawbacks. Other components of a wired pipe system include cross-overs, jars, float subs, saver subs, dills collars, top drives, Kelly valves, stabilizers, interface subs, swivels, intensifier subs, lifting subs, bypass interface tools, pipe, wired pipe, reamers, booster assemblies, and slingers, the details of which are publicly available from companies such as National Oilwell Varco. Generally a wired pipe system includes at least one of the aforementioned components. Generally, the term "sub" is short for "subsystem."

In the present invention, a power supply comprising a HTRES is included in at least a portion of a wired pipe system. In some embodiments, the power supply is included in a booster sub. In other embodiments, the power supply is included in a separate sub designed particularly to house the power supply.

In various embodiments, the HTRES may be of the type described in any of International Patent Application No. PCT/US2012/039342, filed July May 24, 2012; International Patent Application No. International Patent Application No. PCT/US2012/04747, filed Jul. 19, 2012; and International Patent Application No. PCT/US14/29992, filed Mar. 15, 2014, the entire contents of each of which are incorporated herein by reference.

In some embodiments, the HTRES included in the power supply complements an energy source and in some embodiments the HTRES replaces an energy source in a conventional wired pipe system. Generally, the HTRES acts as a "buffer." For example, when the energy source is a lithium battery ("battery"), the HTRES may be coupled to control electronics for charging at a relatively low rate from the battery or at a substantially constant rate so that a useable life of the battery is extended. In some embodiments, the buffer operation described above may extend a run-time by about 10% to about 100%. Additionally, the buffer operation may provide for higher power. For instance, a HTRES may exhibit peak power levels up to about 10,000 W. In another example, the HTRES may be coupled to control electronics for charging from a generator. Examples of generators include flow-induced rotary generators, vibrational energy generators, thermoelectric, piezoelectric, thermo-photovoltaic, and tribo-electric generators. The HTRES may be charged when power is available from the generator or it may be charged at a low rate from the generator. Power may then be provided from the HTRES in a substantially constant fashion or at higher power levels than are available from the generator. Higher power capability may enable the use of fewer booster subs compared to prior art or it may allow for contingency support in the case of failed or poor connections or wired pipe sections or transmission through other subs by boosting the power to overcome poor conduction or transmission in those sections.

One skilled in the art will recognize that the HTRES may be used in conjunction with technologies and instrumentation in support of resistivity, capacitance, nuclear including pulsed neutron and gamma measuring, passive gamma measuring, as well as others, magnetic resonance imaging, acoustic, and/or seismic measurements, flow measurements, various sampling protocols, communications, data processing and storage, geo-steering and a myriad of other requirements for power use downhole. A great compliment of components may also be powered by the HTRES. Non-limiting examples include accelerometers, magnetometers, sensors, transducers, digital and/or analog devices and the like. In some embodiments, the HTRES may power instruments of the type described in International Patent Application No. PCT/US14/59775, filed Nov. 24, 2014, the entire contents of which are incorporated herein by reference.

Figure 3:
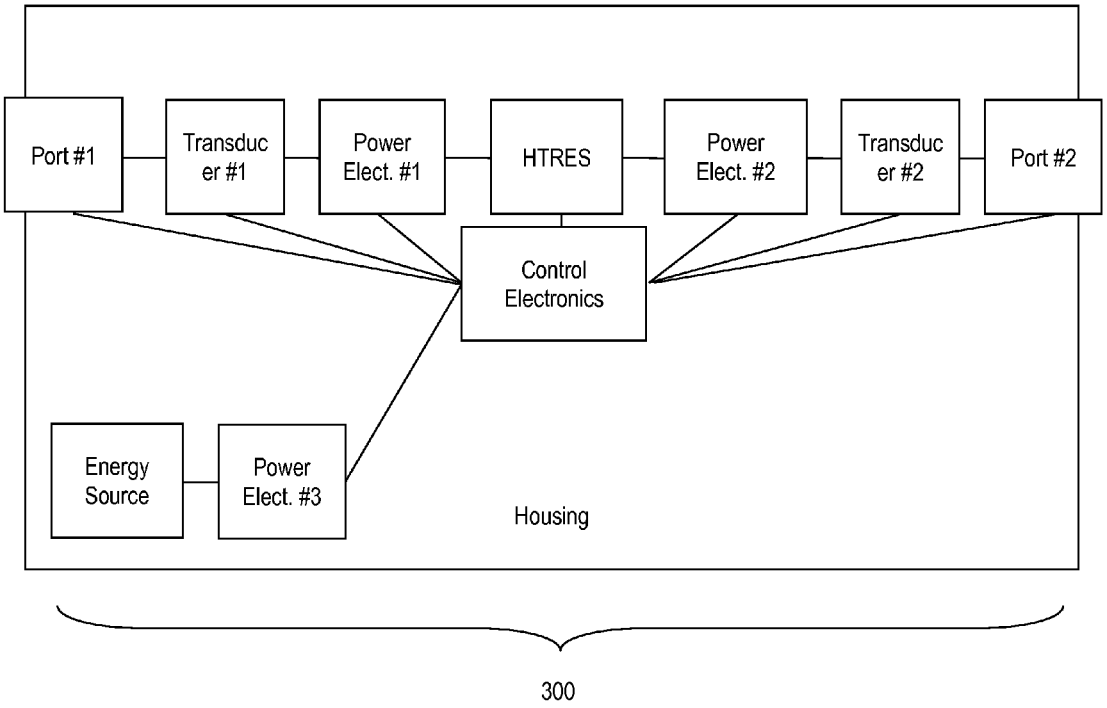
FIG. 3 depicts an embodiment of a wired pipe segment featuring a power supply that includes an HTRES.

Referring now to FIG. 3, aspects of the power supply 300 disclosed herein generally include at least a first port, a second port, a first transducer, a second transducer, control electronics, power electronics, an energy source, a HTRES, and a housing. Generally any number of ports, transducers, HTRES, power electronics, control electronics and energy sources may be used and, generally, any aspect of the power supply may be in communication with any other aspect of the power supply. The ports are generally in communication with systems that fall outside of the housing and with the transducers. The electrical ports and/or transducers are generally in electrical communication with the electronics, HTRES and energy source by means of electrical conductors or couplers. Control and power electronics (electronics) may control flow of electricity between any of the energy source and the HTRES, and the transducers.

In various embodiments, the control and power electronics may be of the type described in any of International Patent Application No. PCT/US2012/039342, filed July May 24, 2012; International Patent Application No. International Patent Application No. PCT/US2012/04747, filed Jul. 19, 2012; and International Patent Application No. PCT/US14/29992, filed Mar. 15, 2014, the entire contents of each of which is incorporated herein by reference.

In various embodiments, one or more of the power supply 300 may be used instead of or in addition to the power supply 115 as shown in FIGS. 1 and 2.

In some embodiments, the transducers comprise inductive couplers, the power electronics comprise bi-directional AC/DC or DC/AC converters for converting ac presented to or from the transducers to dc presented to or from the energy source or HTRES. In some embodiments, the electronics comprise linear amplifiers for providing an amplified signal. In some embodiments the electronics comprise rectifiers for providing DC from AC.

In some embodiments an energy source is omitted. In those embodiments a HTRES may be coupled to control electronics for capturing energy from at least one transducer. For instance, a booster may comprise only a first and second transducer, control and power electronics, a HTRES and housing. The control electronics may receive electricity by way of a transducer and communicate the electricity to the HTRES for charging. The electronics may be controlled to charge the HTRES until a pre-determined amount of energy has been stored, for instance, between about 10 and 1,000,000 Joules, and then to provide a electricity or a restored electrical signal by way of discharging the stored energy in the HTRES. The restored electrical signal may mimic an aspect of a received electrical signal, an aspect of which may be stored in a memory during charging.

Control electronics may sense a received electrical signal from at least one transducer, apply filtering or active signal conditioning in the form of synchronous detection by way of down-modulation and subsequent filtering or other conditioning and then control at least one of the converters or amplifiers according to the received electrical signal in order to provide for a restored electrical signal. Control electronics may simply amplify a received electrical signal in order to provide for a restored electrical signal. The electronics may be controlled to first charge a HTRES from an energy source and then provide power intermittently in high power bursts. The electronics may be controlled to store a received signal in memory for transmission at a later interval. The electronics may be controlled to provide instantaneous high power from the HTRES as part of a periodic alternating signal. A transducer may be an inductive coupler such as that described in Boyle, an electrostatic coupler, an electrical (ohmic) connection such as that in Madhavan, an RF antenna, or other transducers deemed useful for providing for electricity in a wired pipe system. The received electrical signal may be ac or dc or some combination, the choice of which will depend on the type of transducer employed.

A housing may comprise a metallic or otherwise rigid body and may be designed to mimic the shape or structure of a wired pipe section such as those described in Boyle and in Madhavan. The housing may include mating connectors at each end to mate with the ends of wired pipe sections or other wired pipe system subs. Mating connectors may be threaded, and may include tapered or non-tapered threads or a combination of tapered and non-tapered threads. An electrical connection or a function of an electrical transducer may be established upon mating of the housing with an adjacent wired pipe section or sub. Typical housing materials include steel and inconel. Typical inner diameters fall in a range between about 1 and 6 inches and an outer diameter in a range between about 2 and 8 inches. A typical wall thickness falls in a range between about 0.25 and 1.5 inches. Generally, a thicker wall will exhibit a higher degree of mechanical strength. An annular cavity may be provided for other components and may have a radial thickness of between about 0.05 and 3 inches. An example housing is described in Boyle.

The HTRES may comprise an ultracapacitor such as the high temperature ultracapacitor described herein. The HTRES may exhibit a form factor suitable for incorporation into a housing as described herein. Practical form factors include cylindrical or prismatic (flat) cells. The HTRES form factor should generally be chosen to allow for a maximum inner diameter of the housing and a minimum outer diameter of the housing. The HTRES, electronics, and transducers may be included in an annular or part of an annular cavity included in the housing. A suitable form factor is a so-called AA cylindrical cell with a diameter of about 15 mm and a length of about 50 mm. Many cells may be incorporated in the annular cavity and connected in parallel or series or a combination thereof as needed to increase operating voltage, operating current, energy capacity, power capability, or the like.

In some embodiments, use of an HTRES and electronics enables use of a stronger, smaller, and/or less expensive electrical cable. In some embodiments, the electrical cable spanning the length of a wired pipe, i.e. between two transducers at the pipe joints and disposed in an annular cavity, may comprise steel rather than copper or aluminum. Advantageously, a steel electrical cable exhibits about ten times the tensile strength and one tenth the cost compared to copper cables. However, steel cables generally exhibit about ten times the electrical resistivity compared to copper cables. By incorporating an HTRES and electronics in wired pipe system, the HTRES may be charged at a low rate from the relatively higher resistance cable and then power may be provided in high power bursts or relatively high instantaneous peak power levels thus overcoming the limitation of steel or higher resistivity cables.

Exemplary steels suitable for use as conductors in a wired pipe include types 304, 304L, 316, and 316L steels as well as carbon steel. Generally a type of steel will be chosen for its resistance to corrosion, mechanical strength and electrical conductivity. 316 stainless steel is a common choice for some long-lived downhole components including cable armor.

Other materials for said conductor may also be employed as seen fit by the designer to achieve tradeoffs in mechanical strength, resistance to corrosion, temperature stability, electrical resistance, mechanical density or otherwise. Examples of other potentially useful materials include titanium, aluminum, nickel, silver, gold and alloys.

In some embodiments, power is transmitted by way of the wired pipe. Generally, both power and information may be transmitted from downhole to the surface or from the surface to downhole. Power and information may be transmitted between distinct power supplies disposed along the length of the well. Power and information may be transmitted in a time multiplexing scheme, for instance, power and/or information is transmitted in one direction for a period of time then in the opposite direction for a second period of time. For example, a system on the surface may transmit power downhole to charge a power supply, i.e. the HTRES included in the power supply is be charged during a period of, e.g., about 10 to 1,000 seconds. Then, the power supply may operate to transmit information to the surface, i.e. information may be transmitted by way of amplitude modulated alternating voltages, for a period of, e.g., about 10 to 1,000 seconds. In other embodiments, power is transmitted downhole and information is transmitted to the surface simultaneously. For instance, while power is transmitted downhole to charge the power supplies, for instance by providing a substantially fixed amplitude alternating voltage, said power supplies may modulate their current draw from the wired pipe to encode information for transmission to the surface. In this scheme, the information can be decoded on the surface by monitoring the resulting current draw. Specifically and for purposes of example, a power supply may draw greater than 0.4 W to encode a 1, and less than 0.3 W to encode a zero. In this example, the "noise margin" is 0.1 W. Meanwhile, the power draw in either state may be used to maintain a charge on the HTRES. Due to uncertainties in transmission efficiency, a pre-determined mapping of power levels to logic levels may not be reliable, especially as wired pipe joint or other wired pipe component resistances change or degrade. Therefore a calibration phase may be included to communicate to the surface the respective power levels corresponding to high and low logic levels. Power may be transmitted to a plurality of power supplies, for instance, those in booster subs disposed at various locations along the length of the well. Power may be received by power supplies by way of an AC/DC converter, a rectifier, a rectifier and a DC/DC converter or combinations of the above coupled to the HTRES. A feedback controlled converter will generally enable control of the direction of power flow despite respective voltages of the HTRES and the voltage of the received signal. In some examples, distinct power supplies are charged sequentially within a well. In other examples, said power supplies are charged simultaneously within a well. In these embodiments, information may be transmitted from the surface to the downhole environment simultaneously, e.g. by way of modulating power transmitted downhole, or not, e.g. only when power is not being transmitted downhole. The non-limiting set of information transfer schemes described herein are for purposes of example only. Many other information transfer or encoding schemes may be realized, for instance by way of phase or frequency modulation of a sinusoidal signal, by way of time-division or frequency-division keying or by combinations thereof.

In some embodiments, a power supply may provide power bursts for powering sensors and instrumentation, electrical actuators or the like that are substantially local to the booster sub. The HTRES may enable relatively high power compared to battery-powered subs.

In some embodiments, a power supply interrupts a wired pipe buss, i.e. the buss connection is not maintained from a first port to a second port in the power supply. In these embodiments, the power supply may draw current from the buss and provide as output a low-impedance, i.e. it acts as a current sink and provides a voltage source. Generally, the power supply provides for bi-directional transmission of electricity so its inputs and outputs may reverse roles. In other embodiments, a power supply shunts a wired pipe buss, i.e. the buss connection is maintained from a first port to a second port. In these embodiments, the power supply may draw current from or inject current onto a low-impedance buss, i.e. it may act as a high-impedance source or sink.

The incorporation of HTRES in the power supplies for wired pipes generally allows for faster data transmission, e.g. by providing for higher power transmission, and indefinite active time, e.g. by enabling recharging from the surface.

In some embodiments, the incorporation of HTRES in the power supplies for wired pipes may allow for other methods of transmitting power and information to be used. For instance, fiber optic cable may provide a minimal amount of power and a high rate of information transfer by way of laser light. The relatively minimal amount of transmitted power may be used as a power source for trickle charging the HTRES. For instance, transducers from light power to electrical power include photodiodes and phototransistors. Including such a transducer in a sub having an HTRES and coupling said tool to a fiber optic line and coupling said fiber optic line to a source of light on the surface creates a means for transmitting both power and information between the surface and the tool. Advantageously, materials typically used in fabricating a fiber optic line are generally less susceptible to corrosion when compared to electrical (metallic) conductors and so require less protection from the borehole environment.

In various embodiments, the HTRES may include one or more ultracapacitors of the types described in any of International Patent No. PCT/US13/27697, filed Feb. 25, 2013; International Patent No. PCT/US14/59971, filed Oct. 9, 2014; and U.S. Provisional Patent No. 62/081,694, filed Nov. 19, 2014, the entire contents of each of which are incorporated herein by reference.

Ultracapacitors of this type may, for example, operate at temperatures as high as 250 degrees Celsius or more for 10,000 charge/discharge cycles and/or over 100 hours or more at a voltage of 0.5 V or more while exhibiting and increase in ESR or less than 100%, e.g. less than about 85% and a decrease in capacitance of less than about 10%. In some embodiments, such ultracapacitors may have a volumetric capacitance of about 5 Farad per liter (F/L), 6 F/L, 7 F/L, 8 F/L, 8 F/L, 10 F/L or more, e.g., in the range of about 1 to about 10 F/L or any sub-range thereof.

In some embodiments, ultracapacitors of the types described herein may exhibit any of: a high volumetric energy density (e.g., exceeding 0.25 Wh/L, 0.5 Wh/L, 1 Wh/L, 2 Wh/L, 3 Wh/L, 4 Wh/L, 5 Wh/L, 6 Wh/L, 7 Wh/L, 8 Wh/L, 9 Wh/L, 10 Wh/L, 11 Wh/L, 12 Wh/L, 15 Wh/L, 18 Wh/L, 20 Wh/L, or more), a high gravimetric energy density (e.g., exceeding 5 Wh/kg, 6 Wh/kg, 7 Wh/kg, 8 Wh/kg, 9 Wh/kg, 10 Wh/kg, 11 Wh/kg, 12 Wh/kg, 15 Wh/kg, 18 Wh/kg, or more), a high volumetric power density (e.g., exceeding 30 kW/L, 40 kW/L, 50 kW/L, 60 kW/L, 70 kW/L, 80 kW/L, 90 kW/L, 100 kW/L, 110 kW/L, 120 kW/L, or more), a high gravimetric power density (e.g., exceeding 30 kW/kg, 40 kW/kg, 50 kW/kg, 60 kW/kg, 70 kW/kg, 80 kW/kg, 90 kW/kg, 100 kW/kg, 110 kW/kg, 120 kw/KG or more), and combinations thereof. In some embodiments, ultracapacitors of the types described herein demonstrate high performance as indicated by the product of energy density and power density, e.g., exceeding 300 Wh-kW/$L^2$, 500 Wh-kW/$L^2$, 700 Wh-kW/$L^2$, or more.

For example, the ultracapacitors disclosed herein are capable of maintaining their performance over a long period of time, e.g., hundreds of thousands, or even millions of charge/discharge cycles. Table 1 below shows the performance of exemplary cells of the type described herein. For the purposes of Table 1, cell lifetime is defined as the number of cycles required before the cell exhibits a reduction in discharge energy of 5% or more or an increase in equivalent series resistance (ESR) of the cell of 25% or more.

TABLE 1

Estimated Ultracapacitor Performance Data

| Cell ID | Cell Volume/ cm^3) | Power Density (kW/L) | Energy Density (Wh/L) | Lifetime (Cycles) | Operating Voltage (V) |
|---|---|---|---|---|---|
| HP | 2 | 100 | 7.0 | >500k | 3.5 |
| HE | 2 | 35 | 11 | >500k | 3.5 |
| HE 350 | 350 | 35 | 18 | >500k | 3.5 |
| HP 350 | 350 | 110 | 7 | >500k | 3.5 |

As trade-offs may be made among various demands of the ultracapacitor (for example, voltage and temperature) performance ratings for the ultracapacitor may be managed (for example, a rate of increase for ESR, capacitance) may be adjusted to accommodate a particular need. Note that in reference to the foregoing, "performance ratings" is given a generally conventional definition, which is with regard to values for parameters describing conditions of operation.

Applicants have found that HTRES devices featuring ultracapacitors of the type described in the references incorporated herein may also be suitable for the extreme vibrations and mechanical shocks found in the downhole environments.

In some embodiments, the HTRES is configured to operate in the presence of vibrations of up to maximum vibration rating for an operational period. In some embodiments the operational period is at least 100 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof. In some embodiments the operational period is at least 500 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof. In some embodiments the operational period is at least 1,000 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof. In some embodiments the operational period is at least 5,000 hours, and the maximum vibration rating is at least 1 Grms, 2 Grms, 5 Grms, 10 Grms, 20 Grms, 30 Grms, 40 Grms, 50 Grms, 60 Grms, 70 Grms, 80 Grms, 90 Grms, 100 Grms, or more, e.g., in the range of 1 to 100 Grms or any sub-range thereof.

In some embodiments, the HTRES is configured to operate in the presence of shocks up to a maximum shock rating. In some embodiments, the shock rating may be at least 10 G, 20 G, 30 G, 50 G, 100 G, 200, G, 300 G, 400 G, 500 G, or more, e.g., in the range of 10 G to 1,000 G or any sub-range thereof.

It should be recognized that the teachings herein are merely illustrative and are not limiting of the invention. Further, one skilled in the art will recognize that additional components, configurations, arrangements and the like may be realized while remaining within the scope of this invention. For example, configurations of layers, electrodes, leads, terminals, contacts, feed-throughs, caps and the like may be varied from embodiments disclosed herein. Generally, design and/or application of components of the ultracapacitor and ultracapacitors making use of the electrodes are limited only by the needs of a system designer, manufacturer, operator and/or user and demands presented in any particular situation.

In support of the teachings herein, various analysis components may be used, including a digital system and/or an analog system. The system(s) may have components such as a processor, storage media, memory, input, output, communications link (wired, wireless, pulsed mud, optical or other), user interfaces, software and firmware programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, additional materials, combinations of materials and/or omission of materials may be used to provide for added embodiments that are within the scope of the teachings herein.

As used herein "C" refers to degrees Celsius. Grms refers to the root mean square average acceleration of a repetitive vibration as a multiple of G, where G is the acceleration due to gravity at the Earth's surface.

When introducing elements of the present invention or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

In the present application a variety of variables are described, including but not limited to components (e.g. electrode materials, electrolytes, etc.), conditions (e.g., temperature, freedom from various impurities at various levels), and performance characteristics (e.g., post-cycling capacity as compared with initial capacity, low leakage current, etc.). It is to be understood that any combination of any of these variables can define an embodiment of the invention. For example, a combination of a particular electrode material, with a particular electrolyte, under a particular temperature range and with impurity less than a particular amount, operating with post-cycling capacity and leakage current of particular values, where those variables are included as possibilities but the specific combination might not be expressly stated, is an embodiment of the invention. Other combinations of articles, components, conditions, and/or methods can also be specifically selected from among variables listed herein to define other embodiments, as would be apparent to those of ordinary skill in the art.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wired pipe segment for use in a downhole environment, the pipe segment comprising:

an uphole connection for outputting or receiving electromagnetic signals to or from an uphole location;

a downphole connection for outputting or receiving electromagnetic signals to or from a downhole location; and a booster for boosting the power of an electromagnetic signal from one of the uphole connection and the downhole connection and outputting a boosted signal to the other one of the uphole connection and the downhole connection;

wherein the booster comprises at least one high temperature rechargeable energy storage (HTRES);

wherein the HTRES is configured to operate at temperatures throughout an operational temperature range comprising the range of 0 C to 150 C;

wherein the HTRES is configured to output power with a peak power of at least 100 W;

wherein the HTRES is configured to operate in the presence of vibrations of up to maximum vibration rating at least 1 times earth gravitational acceleration in root mean square acceleration (Grms) for an operational period of at least 100 hours;

wherein the HTRES is configured to operate in the presence of shocks up to a maximum shock rating of at least 10 G;

wherein the HTRES comprises an ultracapacitor; and wherein the ultracapacitor is configured to:

store energy input from an energy source at a relatively lower power and relatively more constant rate; and output energy at a relatively higher power at a relatively more pulsed or intermittent rate.

2. The wired pipe segment of claim 1, wherein the operational temperature range comprises the range of 0 C to 210 C.

3. The wired pipe segment of claim 1, wherein the operational temperature range comprises the range of 0 C to 250 C.

4. The wired pipe segment of claim 1, wherein the operational temperature range comprises the range of −40 C to 210 C.

5. The wired pipe segment of claim 1, wherein the operational temperature range comprises the range of −40 C to 250 C.

6. The wired pipe segment of claim 4, wherein the peak power is at least 500 W.

7. The wired pipe segment of claim 4, wherein the peak power is at least 1 kW.

8. The wired pipe segment of claim 4, wherein the peak power is at least 10 kW.

9. The wired pipe segment of claim 4, wherein the peak power is at least 100 kW.

10. The wire pipe segment of claim 4, wherein the the HTRES is configured to operate in the presence of vibrations of up to maximum vibration rating at least 20 Grms for an operational period of at least 100 hours.

11. The wired pipe segment of claim 4, wherein the HTRES is configured to operate in the presence of vibrations of up to maximum vibration rating at least 20 Grms for an operational period of at least 1,000 hours.

12. The wired pipe segment of claim 4, wherein the HTRES is configured to operate in the presence of vibrations of up to maximum vibration rating at least 30 Grms for an operational period of at least 1,000 hours.

13. The wired pipe segment of claim 12, wherein the HTRES is configured to operate in the presence of vibrations of up to maximum vibration rating at least 50 Grms for an operational period of at least 100 hours.

14. The wired pipe segment of claim 1, wherein the energy source comprises at least one of:

a battery, a downhole generator, a wire line, and combinations thereof.

15. The wired pipe segment of claim 1, wherein the HTRES is configured to provide pulsed power to one or more downhole instruments having intermittent peak power demand.

16. The wired pipe segment of claim 1, wherein the energy source comprises a battery included in the wired pipe segment.

17. The wired pipe segment of claim 16, wherein the battery comprises a lithium battery.

18. The wired pipe segment of claim 1, wherein the wired pipe segment is substantially free of any lithium based energy storage elements.

19. The wired pipe segment of claim 1, further comprising control electronics configured to control the booster.

20. The wired pipe segment of claim 19, wherein the electromagnetic signal boosted by the booster comprises encoded information, and wherein the control electronics and booster are configured to operate as a signal repeater configured to:

detect the encoded information; and generate a power boosted electromagnetic signal encoded with the detected information.

21. The wired pipe segment of claim 20, wherein the control electronics are configured to:

receive an external control signal via one of the downhole connection and the uphole connection; and control the booster in response to the external control signal.

22. The wired pipe segment of claim 1, comprising a wire or cable providing an electrically conducting connection between the uphole connection and the downhole connection, wherein:

the booster is configured to boost an electromagnetic signal transmitted through the wire or cable; and the wire or cable is formed of a material having a higher tensile or shear strength than copper or aluminum and a lower electrical conductivity than copper or aluminum.

23. A system comprising:

a wired downhole pipe comprising a plurality of wired pipe segments;

wherein one or more of the wired pipe segments comprises the wired pipe segment of claim 1.

24. A method comprising:

providing a wired downhole pipe comprising the system of claim 23, transmitting power or information between a topside or uphole location and one or more downhole instruments.

* * * * *